US010156108B2

(12) United States Patent
Kostrov et al.

(10) Patent No.: US 10,156,108 B2
(45) Date of Patent: Dec. 18, 2018

(54) METHOD AND APPARATUS FOR SEISMIC STIMULATION OF PRODUCTION HORIZONS OF HYDROCARBON BEARING FORMATIONS

(71) Applicants: Sergey A. Kostrov, Frisco, TX (US); William O. Wooden, Frisco, TX (US)

(72) Inventors: Sergey A. Kostrov, Frisco, TX (US); William O. Wooden, Frisco, TX (US)

(73) Assignee: Applied Seismic Research Corporation, McKinney, TX (US)

( * ) Notice: Subject to any disclaimer, the term of this patent is extended or adjusted under 35 U.S.C. 154(b) by 473 days.

(21) Appl. No.: 14/756,479

(22) Filed: Oct. 6, 2015

(65) Prior Publication Data

US 2017/0096869 A1 Apr. 6, 2017

(51) Int. Cl.
*E21B 28/00* (2006.01)
*E21B 43/00* (2006.01)

(52) U.S. Cl.
CPC ..... *E21B 28/00* (2013.01); *E21B 43/003* (2013.01)

(58) Field of Classification Search
CPC ..... E21B 28/00; E21B 43/003
See application file for complete search history.

(56) References Cited

U.S. PATENT DOCUMENTS 6,015,010 A 1/2000 Kostrov
6,899,175 B2 5/2005 Kostrov et al.
(Continued)

FOREIGN PATENT DOCUMENTS

RU 2075596 C1 3/1997
RU 2139405 C1 10/1999
(Continued)

OTHER PUBLICATIONS

V.N. Nikolayevsky et. Al., "Residual Oil Reservoir Recovery with Seismic Vibrations", SPE 29155, Production & Facility, May 1995, pp. 89-94.
Sobey, Ian J., "Oscillatory flows at intermediate Strouhal number in asymmetry channels", Journal of Fluid Mechanics, Dec. 1982, pp. 359-373, vol. 125.
Sakamoto, H., et al, "A study on vortex shedding from spheres in uniform flow", Journal of Fluids Engineering, Dec. 1990, pp. 386-392, vol. 112.
Melvin, A., "Modeling a shock wave source for seismic well survey," Shock Waves, 1998, pp. 257-265, vol. 8, Springer Verlag.
Kostrov, Sergey, et al, "In situ seismic stimulation shows promise for revitalizing mature fields," Oil & Gas Journal, Apr. 18, 2005, pp. 2-8.

*Primary Examiner* — Caroline N Butcher
(74) *Attorney, Agent, or Firm* — Laubscher & Laubscher, P.C.

(57) ABSTRACT

The method and apparatus for producing shock waves in a well including a device connected to the bottom of the tubing string in a borehole of the well filled by liquid and containing the upper and lower plungers movably arranged within corresponding cylinders for compressing a liquid inside the compression chamber and discharging the liquid into the borehole on upstroke thereby generating a shock wave. In addition, a length of upstroke $L_{str}$ is determined by the following expression:

$$L_{str} \geq H_1 + \frac{(D_1^2 - D_2^2)A_{sw}L_2}{Ed_r^2},$$

where $H_1$ is a length of a lower cylinder, $L_2$ is a distance between lower and upper plungers, $D_1$ is a diameter of the
(Continued)

lower plunger, $D_2$ is a diameter of the upper plunger, $A_{sw}$ is a required amplitude of a generated shock wave, E is an elasticity modulus of a sucker rod's material, $d_r$ is a diameter of the sucker rods.

9 Claims, 2 Drawing Sheets

(56) References Cited

U.S. PATENT DOCUMENTS

| | | | | |
|---|---|---|---|---|
| 7,644,759 | B2 | 1/2010 | Davidson | |
| 7,980,301 | B1 | 7/2011 | Kostrov et al. | |
| 8,459,351 | B2 | 6/2013 | Kostrov et al. | |
| 8,684,076 | B2 | 4/2014 | Kostrov et al. | |
| 2003/0201101 | A1 | 10/2003 | Kostrov et al. | |
| 2011/0162853 | A1* | 7/2011 | Kostrov | E21B 43/127 166/380 |
| 2012/0175107 | A1 | 7/2012 | Kostrov et al. | |
| 2012/0211225 | A1* | 8/2012 | Kostrov | E21B 43/126 166/249 |
| 2015/0218924 | A1* | 8/2015 | Kostrov | E21B 43/26 166/249 |

FOREIGN PATENT DOCUMENTS

| | | | |
|---|---|---|---|
| RU | 2249685 | C | 10/2005 |
| RU | 62658 | U1 | 4/2007 |
| RU | 2327034 | C2 | 6/2008 |

* cited by examiner

METHOD AND APPARATUS FOR SEISMIC STIMULATION OF PRODUCTION HORIZONS OF HYDROCARBON BEARING FORMATIONS

BACKGROUND OF THE INVENTION

The present invention relates to a shock wave generating method and device and, more particularly, to a method and device for repeatedly generating shock waves in a well borehole to enhance oil recovery and increase oil production and to carry out continuous seismic surveys of an hydrocarbon bearing formation.

BRIEF DESCRIPTION OF PRIOR ART

The U.S. Pat. No. 6,015,010, U.S. Pat. No. 6,899,175 and U.S. Pat. No. 7,980,301 disclose methods and apparatuses for increasing the efficiency of the shock wave stimulation of the hydrocarbon bearing beds. However the implementation of methods in accordance with U.S. Pat. No. 6,015,010, U.S. Pat. No. 6,899,175, U.S. Pat. No. 8,459,351 and U.S. Pat. No. 7,980,301 have their drawbacks, i.e. the methods and apparatuses are not the optimal ones from the point of view of the efficiency of the devices implemented in accordance with U.S. Pat. No. 6,015,010, U.S. Pat. No. 6,899,175, U.S. Pat. No. 8,459,351 and U.S. Pat. No. 7,980,301. In particularly the efficacy of the device's implementation could be substantially enhanced from the point of view matching the generated vibration frequency to so called dominant frequency of the hydrocarbon bearing production horizon.

The present invention was developed to overcome drawbacks of prior methods and devices by providing the improved method and apparatus for producing shock waves in a borehole of the well filled or partially filled by the liquid.

SUMMARY OF INVENTION

Accordingly, a primary object of a first embodiment of the present invention is to provide the method for producing a shock wave in wells filled or partially filled by a liquid which includes a pumping unit arranged at the wellhead, a tubing string extending downwardly into the well borehole, a damper cylinder connected to the bottom of the tubing string at the upper end and to a damper chamber at the lower end. The damper chamber is connected to an upper cylinder. In addition, the damper cylinder has a different internal diameter than internal diameter of the upper cylinder. The damper plunger is movably arranged within damper cylinder and connected to the pumping unit by means at least one sucker rod and a polish rod at the upper end and to the upper plunger at the lower end, which in turn is movably arranged within the upper cylinder, for creating a constant counterforce inside the damper chamber on upstroke of the pumping unit as a result of a constant flow of the fluid from the damper chamber into the borehole of the well or from the borehole of the well into the damper chamber through at least one through opening on the side surface of the damper chamber or, as an alternative, through the channel inside a damper plunger hydraulically connecting damper chamber with tubing string. In addition, the upper cylinder is connected to a lower cylinder via compression chamber and the upper cylinder has a smaller internal diameter than the lower cylinder. A lower plunger movably arranged within the lower cylinder and the upper and lower plungers are connected to each other by means of at least one sucker rod for compressing a liquid contained within the compression chamber and discharging the liquid into borehole of a well when the lower plunger exits out of the lower cylinder on the upstroke of a pumping unit thereby generating a shock wave. In addition, providing a length of the upstroke $L_{str}$ of the pumping unit determined by the following expression:

$$L_{str} \geq H_1 + \frac{(D_1^2 - D_2^2)A_{sw}L_2}{Ed_r^2},$$

where $H_1$ is the length of the lower cylinder, $L_2$ is the distance between the top of the lower plunger and the bottom of the upper plunger, $D_1$ is the diameter of the lower plunger, $D_2$ is the diameter of the upper plunger, $A_{sw}$ is the required amplitude of the generated shock wave, E is a modulus of the elasticity of the sucker rod's material, $d_r$ is the diameter of the sucker rods.

It is another object of the invention to provide the method for producing a shock wave in wells filled or partially filled by liquid in which the pumping unit operates during from 1 minute to 24 hours per day.

It is a further object of the present invention to provide an apparatus for producing a shock wave in wells filled or partially filled by the liquid comprising of the device connected to the bottom of the tubing string in the borehole of the well filled by the liquid and consisting of the damper cylinder connected to the bottom of the tubing string at the upper end and to the damper chamber at the lower end and the damper chamber is connected to the upper cylinder, the damper cylinder has a different internal diameter than the internal diameter of the upper cylinder and the damper chamber has a hydraulic connection with the borehole of the well via at least one hole on its side surface, a damper plunger movably arranged within the damper cylinder and connected to the pumping unit by means at least one sucker rod and polish rod at the upper end and connected to the upper plunger by at least one sucker rod at the lower end for creating the constant counterforce inside the damper chamber on the upstroke of the pumping unit as a result of the constant flow of the fluid from the damper chamber into the borehole of the well or from the borehole of the well into the damper chamber through at least one hole on the side surface of the damper chamber or, as an alternative, through the channel inside a damper plunger hydraulically connecting damper chamber with tubing string, the upper cylinder connected to a lower cylinder via compression chamber and having the smaller internal diameter than the internal diameter of the lower cylinder, the upper plunger connected to the lower plunger by means of at least one sucker rod and the upper and lower plungers movably arranged within the upper and lower cylinders, correspondingly, for compressing the liquid contained within the compression chamber and discharging the liquid into the borehole when the lower plunger exits out of the lower cylinder on upstroke of the pumping unit thereby generating the shock wave. In addition, the lower plunger has at least one truncated conical taper at the lower end and said truncated conical taper has an angle Ψ relatively to a vertical symmetry axis of the lower plunger determined by the following formulae:

$$\psi = \frac{1}{3}\text{arccos}ine\left[\frac{2S(1-\varphi)n_S L_{str}(D_1^2 - d_r^2)}{C_s \Delta t D_1^3}\right],$$

where $\Psi$ is the angle of the truncated conical taper on the lower end of the lower plunger, $\varphi$ is a total slippage of the fluid between the lower and upper cylinders and the lower and upper plungers, correspondingly, $n_S$ is a Strouhal number, $L_{str}$ is the length of the upstroke of the pumping unit, $D_1$ is the diameter of the lower plunger, $d_r$ is the diameter of the sucker rods, $C_s$ is a velocity of a shear wave in the hydrocarbon bearing formation sublayer, $\Delta t$ is the discharging time of the compressed liquid from the compression chamber, S is a thickness of the hydrocarbon bearing formation sublayer having the particular dominant frequency.

It is another object of the invention to provide the apparatus for producing the shock wave in wells filled or partially filled by the liquid in which the length l of the truncated conical taper on the lower end of the lower plunger is determined by the following expression:

$$0.1D_1 \le l \le \frac{D_1}{2\tan\psi},$$

where l is the length of the truncated conical taper on the lower end of the lower plunger, $D_1$ is the diameter of the lower plunger, $\Psi$ is the angle of the truncated conical taper on the lower end of the lower plunger.

It is another object of the invention to provide the apparatus for producing the shock wave in wells filled or partially filled by the liquid in which the taper of the lower plunger at the lower end of said plunger has a truncated spherical shape thereby creating a truncated spherical taper and said truncated spherical taper has a spherical radius R and the diameter $d_s$ at the bottom of said truncated spherical taper determined by the following expressions:

$$d_s = D_1 - l \tan \psi$$

$$R \ge l \cos \psi$$

where l is length of said truncated conical taper on the lower end of the lower plunger, $D_1$ is the diameter of the lower plunger, $\Psi$ is the angle of said truncated taper on the lower end of the lower plunger.

It is another object of the invention to provide the apparatus for producing the shock wave in wells filled or partially filled by the liquid in which the taper of the lower plunger at the lower end of said plunger has a truncated ellipsoidal shape thereby creating a truncated ellipsoidal taper and the diameter $d_e$ at the bottom of said truncated ellipsoidal taper is determined by the following expression:

$$d_e = D_1 - l \tan \psi,$$

where l is length of said truncated conical taper on the lower end of the lower plunger, $D_1$ is the diameter of the lower plunger, $\Psi$ is the angle of said truncated taper on the lower end of the lower plunger.

It is another object of the invention to provide the apparatus for producing the shock wave in wells filled or partially filled by the liquid in which the taper of the lower plunger at the lower end of said plunger has a truncated hyperboloid shape thereby creating a truncated hyperboloid taper and the diameter $d_h$ at the bottom of said truncated hyperboloid taper is determined by the following expression:

$$d_h = D_1 - l \tan \psi,$$

where l is length of said truncated taper on the lower end of the lower plunger, $D_1$ is the diameter of the lower plunger, $\Psi$ is the angle of said truncated conical taper on the lower end of the lower plunger.

It is another object of the invention to provide the apparatus for producing the shock wave in wells filled or partially filled by the liquid in which the distance $L_2$ between the top of the lower plunger and the bottom of the upper plunger is determined by the following expression:

$$\frac{H_1 + L_1 - (l_1 + l_2 + L_{str})}{1 - \frac{(D_1^2 - D_2^2)A_{sw}}{Ed_r^2}} \le L_2 \le (H_1 + H_2 + L_1) - (l_1 + l_2 + L_{str}),$$

where $H_1$ is the length of the lower cylinder, $H_2$ is the length of the upper cylinder, $l_1$ is the length of the lower plunger, $L_1$ is the length of the compression chamber, $l_2$ is the length of the upper plunger, $L_{str}$ is the length of the upstroke of the pumping unit, $D_1$ is the diameter of the lower plunger, $D_2$ is the diameter of the upper plunger, $A_{sw}$ is the required amplitude of the generated shock wave, E is the modulus of the elasticity of the sucker rod's material, $d_r$ is the diameter of the sucker rods.

It is another object of the invention to provide the apparatus for producing the shock wave in wells filled or partially filled by the liquid in which the distance $L_4$ between the bottom of the damper plunger and the top of the upper plunger is determined by the following expression:

$$H_1+H_2+H_3+L_1+L_3-(l_1+l_2+L_2+l_3+L_{str}) \le L_4 \le (H_1+H_2+H_3+L_1+L_3+l_3)-(l_1+l_2+L_2+L_{str}),$$

where $H_1$ is the length of the lower cylinder, $H_2$ is the length of the upper cylinder, $l_1$ is the length of the lower plunger, $L_1$ is the length of the compression chamber, $l_2$ is the length of the upper plunger, $l_3$ is the length of the damper plunger, $H_3$ is the length of the damper cylinder, $L_3$ is the length of the damper chamber, $L_2$ is the distance between the top of the lower plunger and the bottom of the upper plunger, $L_{str}$ is the length of the stroke of the pumping unit.

It is another object of the invention to provide the apparatus for producing the shock wave in wells filled or partially filled by the liquid in which in order to compensate for the stretching and bucking of the sucker rods inside the tubing the total length of the sucker rods connecting the top of the damper plunger and the bottom of said polish rod is reduced compared with the distance $L_5$ between the bottom of said polish rod and top of the damper plunger at the position of the pumping unit corresponding to the bottom or start of an upstroke by distance $\lambda$ determined by the following formulae:

$$\lambda \ge \frac{H}{E}\left[\frac{(D_1^2 - D_2^2)A_{sw}}{d_r^2} + \frac{gH(\rho_s - \rho_f)}{2}\right] + H\eta,$$

where $D_1$ is the diameter of the lower plunger, $D_2$ is the diameter of the upper plunger, $A_{sw}$ is the required amplitude of the generated shock wave, H is the positional depth of the bottom of the lower plunger corresponding to the bottom/start of the pumping unit upstroke, E is the modulus of the elasticity of the sucker rod's material, $d_r$ is the diameter of the sucker rods, $\rho_s$ is a density of the pumping means material, $\rho_s$ is the density of the liquid, $\pi$=3.1415, $\eta$ is a buckling coefficient of the sucker rods inside the tubing per unit of the tubing length.

BRIEF DESCRIPTION OF THE DRAWINGS

Other objects and advantages of the invention will become apparent from the study of the following specification when viewed in light of the accompanying drawings, in which.

DETAILED DESCRIPTION

Figure 1:
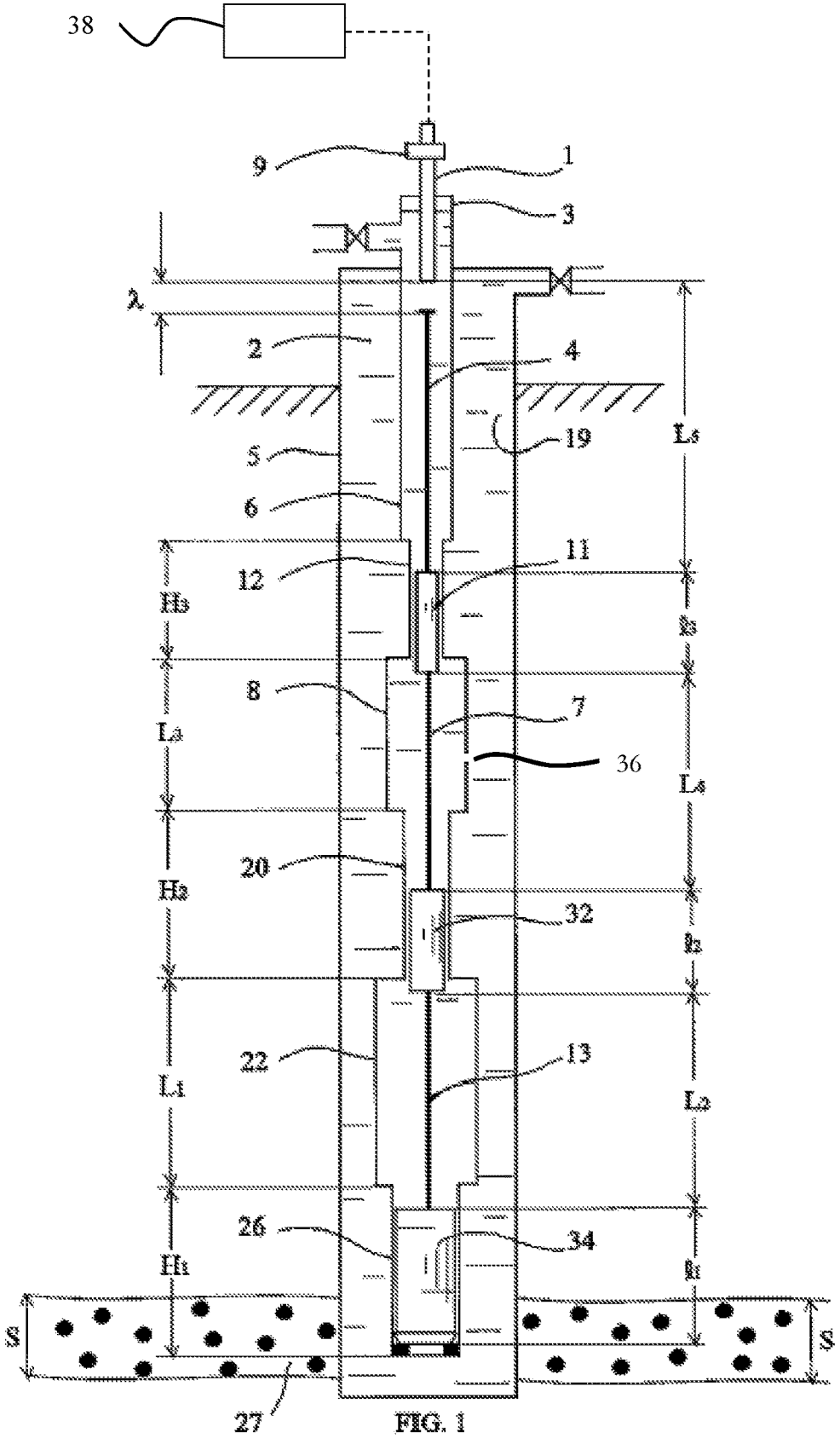
FIG. 1 is a cross-sectional side view of the device installed in the well borehole according to the invention.

Referring to FIG. 1 there is shown a device for producing a shock wave in borehole 19 of a well filled or partially filled by the liquid 2. The device includes a pumping unit 38 arranged at the wellhead of the well, a tubing string 6 extending downwardly into the production casing 5 of the well, the damper cylinder 12 installed at the end of the tubing string 6, the damper chamber 8 installed at the end of the damper cylinder 12 and connected to the upper cylinder 20 which in turn is connected to the compression chamber 22 connected to the lower cylinder 26. The damper plunger 11 is moveably arranged within the damper cylinder 12 and connected at its upper end to the pumping unit 38 by at least one first sucker rod 4 and a polish rod 1 movably arranged in the stuffing box 3, and connected at its lower end by at least one second sucker rod 7 to the upper plunger 32 for creating a constant counterforce inside said damper chamber 8 on an upstroke of the pumping unit 38 as a result of the constant flow of the fluid from the damper chamber 8 into the borehole 19 of the well or from the borehole of the well 19 into the damper chamber 8 through at least one through opening 36 on the side wall of the damper chamber 8 and said upper plunger 32 is moveably arranged within upper cylinder 20. The polish rod 1, in turn, is connected to the horse head (not shown) of the pumping unit 38 by the carrier 9. The upper plunger 32 is connected at its lower end to the lower plunger 34 by means of at least one third sucker rod 13 and the lower plunger 34 is moveably arranged within the lower cylinder 26 for compressing a liquid contained within the compression chamber 22 and discharging the liquid into the borehole 19 of the well when the lower plunger 34 exits out of the lower cylinder 26 on the upstroke of the pumping unit 38 thereby generating a shock wave. In addition, a length of the stroke $L_{str}$ of the pumping unit 38 determined by the following expression:

$$L_{str} \geq H_1 + \frac{(D_1^2 - D_2^2)A_{sw}L_2}{Ed_r^2},$$

where $H_1$ is the length of the lower cylinder 26, $L_2$ is the distance between the top of lower plunger 34 and bottom of the upper plunger 32, $D_1$ is the diameter of the lower plunger 34, $D_2$ is the diameter of the upper plunger 32, $A_{sw}$ is the required amplitude of the generated shock wave, E is a modulus of elasticity of the sucker rod's material, $d_r$ is the diameter of the sucker rods 4, 7 and 13. In particular, length of stroke $L_{str} \geq 3.66$ m for the following parameters: $H_1=3.65$ m $L_2=32$ m, $D_1=0.082$ m, $D_2=0.07$ m, $A_{sw}=24.5$ MPa, $E=2\times10^{11}$ Pa, $d_r=0.0254$ m.

Figure 2:
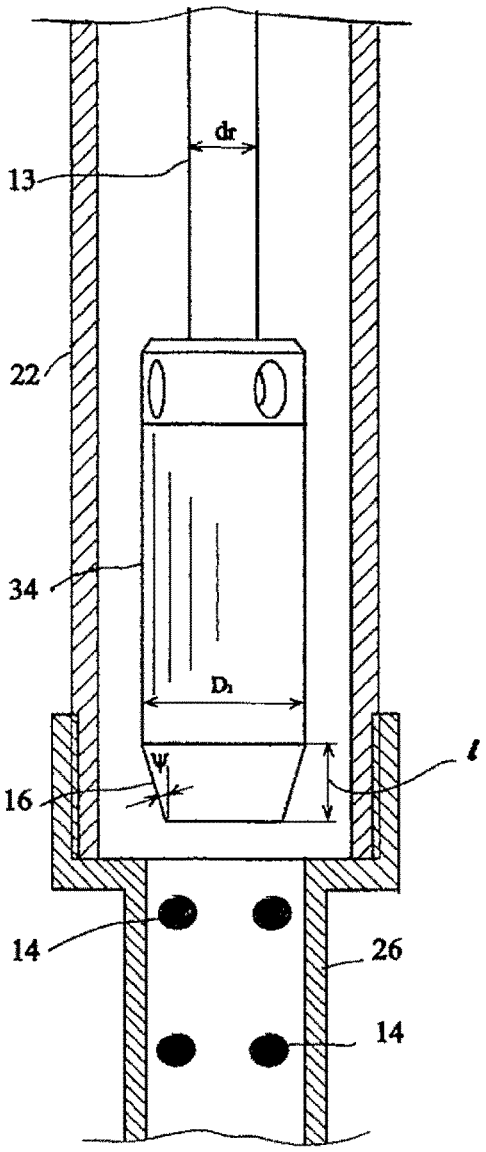
FIG. 2 is a cross-sectional view of the compression chamber, the lower cylinder and the lower plunger with the truncated conical taper.

As shown on FIG. 1, a hydrocarbon bearing formation sublayer 27 has a thickness S. Every such particular sublayer 27 has its own, so called, dominant frequency $f_d$, i.e. the frequency on which the elastic waves propagate through this sublayer 27 with the lowest attenuation coefficient thereby reaching farther distance compared with the elastic waves on other frequencies. The dominant frequency $f_d$ can be estimated by the simple expression (see for instance V. N. Nikolayevsky et. Al., "Residual Oil Reservoir Recovery with Seismic Vibrations", SPE 29155, Production & Facility, May 1995, pp. 89-94):

$$f_d = \frac{C_s}{4S},$$

wherein $C_s$ is a velocity of a shear wave in the hydrocarbon bearing formation sublayer 27 and S is a thickness of the hydrocarbon bearing formation sublayer 27 having the particular dominant frequency $f_d$. On another hand, when the lower plunger 34 exits out of the lower cylinder 26 on every upstroke of the pumping unit 38 thereby generating the shock wave, the discharged flow of liquid, in turn, generates the vibrations due to creating a periodic vortices 14 in accordance with well known phenomenon of an auto-oscillations discovered by V. Strouhal in $19^{th}$ century. More details about phenomenon of auto-oscillations could be found for example in the articles: Sobey, Ian J. (1982). "Oscillatory flows at intermediate Strouhal number in asymmetry channels". *Journal of Fluid Mechanics*, N. 125: 359-373 and Sakamoto, H.; Haniu, H. (1990). "A study on vortex shedding from spheres in uniform flow". Journal of Fluids Engineering, N 112 (December 1992): 386-392. Therefore the further object of the present invention is to provide an apparatus for producing shock waves which, in turn, generate the vibrations on the frequency equaled the dominant frequency $f_d$ thereby providing the resonant mode. Such apparatus in wells filled or partially filled by liquid comprising of the device connected to the bottom of the tubing string 6 in the borehole 19 of the well filled by liquid and consisting of the damper cylinder 12 connected to the bottom of the tubing string 6 at the upper end and to the damper chamber 8 at the lower end and the damper chamber 8 is connected to the upper cylinder 20, the damper cylinder 12 having a different internal diameter than the internal diameter of the upper cylinder 20 and the damper chamber 8 has a hydraulic connection with borehole 19 of the well via at least one through opening on the side surface of said damper chamber 8 or, as an alternative, through the channel (not shown) inside the damper plunger 11 hydraulically connecting damper chamber 8 with tubing string 6, the damper plunger 11 movably arranged within the damper cylinder 12 and connected to the pumping unit 38 by means at least one a first sucker rod 4 and a polish rod 1 at the upper end and connected to the upper plunger 32 by at least one second sucker rod 7 at the lower end for creating a constant counterforce inside the damper chamber 8 on the upstroke of the pumping unit 38 as a result of a constant flow of the fluid from the damper chamber 8 into the borehole 19 of the well or from the borehole 19 of the well into the damper chamber 8 through at least one through opening on the side wall of the damper chamber 8, the upper cylinder 20 connected to a lower cylinder 26 via a compression chamber 22 and having a smaller internal diameter than the internal diameter of the lower cylinder 26, the upper plunger 32 connected to the lower plunger 34 by at least one third sucker rod 13 and the upper 32 and lower 34 plungers movably arranged within the upper 20 and lower 26 cylinders, correspondingly, for compressing a liquid contained within the compression chamber 22 and discharging the liquid into the borehole 19 when the lower plunger 34 exits out of the lower cylinder 26 on the upstroke of the pumping unit 38 thereby generating the shock wave. In addition, the lower plunger 34 has at least one truncated conical taper 16 at the lower end (see FIG. 2) and said truncated conical taper 16 has an angle Ψ relatively to a vertical symmetry axis of the lower plunger 34 determined by the following formulae:

$$\psi = \frac{1}{3}\arccos ine\left[\frac{2S(1-\varphi)n_S L_{str}(D_1^2 - d_r^2)}{C_s \Delta t D_1^3}\right],$$

wherein Ψ is the angle of the truncated conical taper 16 on the lower end of the lower plunger 34, φ is the total slippage of the fluid between the lower 26 and upper 20 cylinders and the lower 34 and upper 32 plungers, correspondingly, $n_S$ is Strouhal number, $L_{str}$ is the length of the upstroke of the pumping unit 38, $D_1$ is the diameter of the lower plunger 34, $d_r$ is the diameter of at least one the third sucker rod 13, $C_s$ is a velocity of a shear wave in the hydrocarbon bearing formation sublayer 27, Δt is the discharging time of the compressed liquid from the compression chamber 22, S is a thickness of the hydrocarbon bearing formation sublayer 27 having the particular dominant frequency $f_d$.

The angle Ψ of the truncated conical taper 16 on the lower end of the lower plunger 34 provides the flowing regime of discharged liquid from the compression chamber 22 in such manner that the appearing vortices 14 will be occurring on the dominant frequency $f_d$ thereby providing the resonant phenomenon. In particularly, for the dominant frequency $f_d$=150 Hz the angle Ψ of the truncated conical taper 16 has to be equaled $17^0$ to provide the resonance under the following parameters: S=2.5 m, φ=0.1, $n_S$=0.21, $L_{str}$=3.6 m, $D_1$=0.082 m, $d_r$=0.0254 m, $C_s$=1500 msec, Δt=0.04 sec. At the same time the length 1 the truncated conical taper 16 described by the following expression:

$$0.1D_1 \le l \le \frac{D_1}{2\tan\psi}$$

will vary in the range 0.0082 m≤l≤0.134 m for $D_1$=0.082 m and Ψ=$17^0$.

Figure 3:
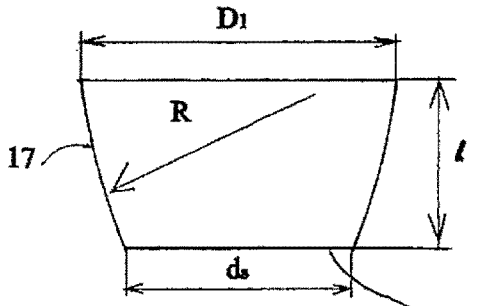
FIG. 3 is view of the lower plunger with the truncated spherical taper.

Referring to FIG. 3, the truncated taper at the lower end of the lower plunger 34 can have the spherical shape. In this case the sphere radius R and the diameter $d_s$ of the low part of the truncated spherical taper 21 are determined by the following expressions:

$$d_s = D_1 - l \tan\psi \text{ and}$$

$$R \ge l \cos\psi,$$

wherein l is the length of the truncated conical taper 16 on the lower end of the lower plunger 34, $D_1$ is the diameter of the lower plunger 34, Ψ is the angle of the truncated conical taper 16 on lower end of the lower plunger In particular, R≥0.048 v for l=0.05 m and Ψ=$17^0$, and $d_s$=0.035 m.

Figure 4:
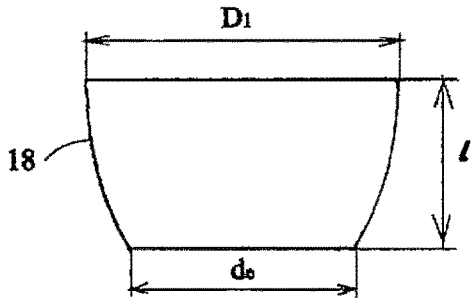
FIG. 4 is view of the lower plunger with the truncated ellipsoidal taper.
Figure 5:
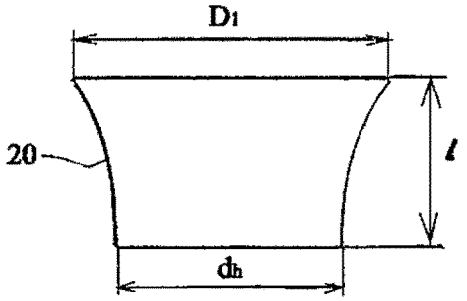
FIG. 5 is view of the lower plunger with the truncated hyperbolic taper.

Referring to FIG. 4 and FIG. 5, the truncated taper at the end of the lower plunger 34 can have the ellipsoidal or hyperbolic shape, correspondingly. For the same parameters, l=0.05 m and Ψ=$17^0$, the corresponding diameters $d_e$ and $d_h$ of the truncated ellipsoidal taper 18 and the truncated hyperbolic taper 20 are equaled: $d_e$=$d_h$=0.035 m for l=0.05 m and Ψ=$17^0$.

During the installation of the device in accordance with invention (see FIG. 1) the distance $L_2$ between the top of the lower plunger 34 and the bottom of the upper plunger 32 has to be set up in accordance with the following expression:

$$\frac{H_1 + L_1 - (l_1 + l_2 + L_{str})}{1 - \frac{(D_1^2 - D_2^2)A_{sw}}{Ed_r^2}} \le L_2 \le (H_1 + H_2 + L_1) - (l_1 + l_2 + L_{str}),$$

wherein $H_1$ is the length of the lower cylinder 26, $H_2$ is the length of the upper cylinder 20, $l_1$ is the length of the lower plunger 34, $L_1$ is the length of the compression chamber 22, $l_2$ is the length of the upper plunger 32, $L_{str}$ is the length of the upstroke of the pumping unit, $D_1$ is the diameter of the lower plunger 34, $D_2$ is the diameter of the upper plunger 32, $A_{sw}$ is the required amplitude of the generated shock wave, E is the modulus of the elasticity of the sucker rod's material, $d_r$ is the diameter of the sucker rods 13. In particular, the distance $L_2$ between the top of the lower plunger 34 and the bottom of the upper plunger 32 varies in the range 28.5 m≤$L_2$≤34.24 m for the following parameters: $H_1$=5.3 m, $H_2$=6.0 m, $l_1$=1.2 m, $L_1$=29 m, $l_2$=1.2 m, $L_{str}$=3.66 m, $D_1$=0.082 m, $D_2$=0.070 m, $A_{sw}$=24.5×$10^6$ Pa, E=2.12×$10^{11}$ Pa, $d_r$=0.0254 m.

The similar set up of the distance $L_4$ between the bottom of the damper plunger 11 and the top of the upper plunger 32 should fulfill the following expression:

$$H_1+H_2+H_3+L_1+L_3-(l_1+l_2+L_2+l_3+L_{str}) \le L_4 \le (H_1+H_2+H_3+L_1+L_3+l_3)-(l_1+l_2+L_2+L_{str}),$$

wherein $H_1$ is the length of the lower cylinder 26, $H_2$ is the length of the upper cylinder 20, $l_1$ is the length of the lower plunger 34, $L_1$ is the length of the compression chamber 22, $l_2$ is the length of the upper plunger 32, $l_3$ is the length of the damper plunger 11, $H_3$ is the length of the damper cylinder 12, $L_3$ is the length of the damper chamber 8, $L_2$ is the distance between the top of the lower plunger 34 and bottom of the upper plunger 32, $L_{str}$ is the length of the upstroke of the pumping unit.

In particular, the distance $L_4$ between the bottom of the damper plunger 11 and the top of the upper plunger 32 varies in the range 16.64 m≤$L_4$≤19.04 m for the following parameters: $H_1$=5.3 m, $H_2$=6.0 m, $H_3$=6.0 m, $l_1$=1.2 m, $L_1$=29 m, $L_2$=32 m, $L_3$=9.6 m, $l_2$=1.2 m, $l_3$=1.2 m, $L_{str}$, =3.66 m.

During the installation of the device in accordance with invention (see FIG. 1) the buckling of the sucker rods 4, 7, 13 as well as the stretching of sucker rods 4, 7, 13 on the upstroke of pumping unit should be compensated. In this case the total length of the sucker rods connecting the top of the damper plunger 11 to the bottom of the polish rod 1 is reduced compared with the distance $L_5$ between the bottom of said polish rod and top of the damper plunger at the position of the pumping unit corresponding to the bottom or start of an upstroke by a distance λ determined by the following formulae:

$$\lambda \ge \frac{H}{E}\left[\frac{(D_1^2 - D_2^2)A_{sw}}{d_r^2} + \frac{gH(\rho_s - \rho_f)}{2}\right] + H\eta,$$

where $D_1$ is the diameter of the lower plunger 34, $D_2$ is the diameter of the upper plunger 32, $A_{sw}$ is the required amplitude of the generated shock wave, H is the depth of the bottom of lower plunger 34 at the bottom of the pumping unit upstroke, E is a modulus of elasticity of the sucker rod's material, $d_r$ is the diameter of the sucker rods 4, $\rho_s$ is the density of the sucker rod's material, $\rho_s$ is the density of liquid, $\pi$=3.1415, $\eta$ is a buckling coefficient of the sucker rods 4 inside the tubing string 6 per unit of tubing length (varies between 0.001 to 0.003 depending on the size of tubing string 6 and sucker rods 4 inside this tubing string 6). The nominal length $L_5$ of sucker rods 4 corresponds to the position of polish rod 1 when the whole sucker rod string consisting of 4, 7 and 13 sucker rods and polish rod 1 are stuck out.

In particular, the distance $\lambda \geq 2.79$ m for the following parameters: $D_1$=0.082 m, $D_2$=0.07 m, $A_{sw}=24.5\times10^6$ Pa, $E=2.12\times10^{11}$ Pa, H=1500 m, $d_r$=0.0254 m, $\rho_s$=7800 kg/m$^3$, $\rho_f$=1000 kg/m$^3$, $\pi$=3.1415, $\eta$=0.0013 (for 25.4 mm sucker rods and 73 mm tubing), g=9.81 m/sec$^2$.

While in accordance with the provisions of the Patent Statutes the preferred forms and the embodiments of the invention have been illustrated and described, it will be apparent to those of ordinary skill in the art various changes and modifications may be made without deviating from the inventive concepts set forth above.

What is claimed is:

1. A method for producing shock waves in a borehole of a well at least partially filled by a liquid and for stimulation of production horizons of hydrocarbon bearing formations, comprising the steps of:

a) positioning a device connected with a bottom of a tubing string extending downwardly into the borehole, the device including:

i) a damper cylinder connected at an upper end with a bottom of said tubing string and at a lower end with a damper chamber;

ii) an upper cylinder connected with said damper chamber, wherein said damper cylinder has an internal diameter different from an internal diameter of said upper cylinder, a side wall of said damper chamber containing at least one through opening which provides a hydraulic connection with the borehole;

iii) a damper plunger arranged for movement within said damper cylinder and connected at an upper end with a pumping unit by at least one first sucker rod and a polish rod and connected at a lower end with an upper plunger by at least one second sucker rod, wherein an upstroke of said pumping unit creates a constant counter force within said damper chamber as a result of a constant flow of the liquid from said damper chamber into the borehole or from the borehole into said damper chamber through said at least one through opening;

iv) a lower cylinder connected with said upper cylinder via a compression chamber, wherein said upper cylinder has an internal diameter that is less than an internal diameter of said lower cylinder;

v) a lower plunger connected with said upper plunger by at least one third sucker rod, said upper and lower plungers being arranged for movement within said upper and lower cylinders, respectively, whereby a shock wave is generated by compressing said liquid contained within said compression chamber and discharging said liquid into the borehole when said lower plunger exits said lower cylinder on said upstroke of said pumping unit;

b) providing a length of an upstroke $L_{str}$ of the pumping unit determined by the following expression:

$$L_{str} \geq H_1 + \frac{(D_1^2 - D_2^2)A_{sw}L_2}{Ed_r^2},$$

wherein $H_1$ is a length of said lower cylinder, $L_2$ is a distance between a top of said lower plunger and a bottom of said upper plunger, $D_1$ is a diameter of the lower plunger, $D_2$ is a diameter of said upper plunger, $A_{sw}$ is a required amplitude of said generated shock wave, E is a modulus of an elasticity of the material of each of said at least one first, at least one second and at least one third sucker rods, and $d_r$ is a diameter of each of said at least one first, at least one second and at least one third sucker rods.

2. A method as defined in claim 1 wherein said pumping unit operates from 1 minute to 24 hours per day.

3. An apparatus for producing shock waves in a borehole of a well at least partially filled by a liquid and for stimulation of production horizons of hydrocarbon bearing formations in the regime of a resonance, comprising:

a) a bottom of a tubing string extending downwardly into the borehole;

b) a damper cylinder connected at an upper end with a bottom of said tubing string and at a lower end with a damper chamber, said damper chamber being connected with an upper cylinder and including a side wall containing at least one through opening, wherein said damper cylinder has an internal diameter different from an internal diameter of said upper cylinder;

c) a damper plunger arranged for movement within said damper cylinder, said damper plunger being connected with a pumping unit at an upper end by at least one first sucker rod and a polish rod and connected with an upper plunger at a lower end by at least one second sucker rod arranged for movement within said upper cylinder, wherein an upstroke of the pumping unit creates a constant counterforce within said damper chamber as the result of the constant flow of said liquid from said damper chamber into the borehole or from the borehole into said damper chamber through said at least one through opening, thereby providing hydraulic communication between said damper chamber and said borehole;

d) a lower cylinder connected with said upper cylinder via a compression chamber, said upper cylinder having an internal diameter that is less than an internal diameter of said lower cylinder;

e) a lower plunger arranged for movement within said lower cylinder, said upper and lower plungers being connected by at least one third sucker rod, whereby a shock wave is generated by compressing the liquid contained within said compression chamber and discharging said liquid into said borehole when said lower plunger exits said lower cylinder on the upstroke of the pumping unit;

wherein said lower plunger lower end has a truncated taper configuration, said truncated taper being selected from a group consisting of a truncated conical taper, a truncated spherical taper, a truncated ellipsoidal taper or truncated hyperboloid taper; and wherein said truncated taper comprises an angle relative to a vertical symmetry axis of the lower plunger determined by the following formulae:

$$\psi = \frac{1}{3}\arccos ine\left[\frac{2S(1-\varphi)n_S L_{str}(D_1^2 - d_r^2)}{C_s \Delta t D_1^3}\right],$$

where ψ is the angle of the truncated taper on the lower end of the lower plunger, φ is a total slippage of the fluid between the lower and upper cylinders and the lower and upper plungers, correspondingly, $n_s$ is a Strouhal number, $L_{str}$ is the length of the upstroke of the pumping unit, $D_1$ is the diameter of the lower plunger, $d_r$ is the diameter of the sucker rods, $C_s$ is a velocity of a shear wave in the hydrocarbon bearing formation sublayer, Δt is the discharging time of the compressed liquid from the compression chamber, S is a thickness of the hydrocarbon bearing formation sublayer having the particular dominant frequency, whereby said angle of said truncated taper provides resonance between frequency of vibrations generated by said apparatus and a dominant frequency of formation.

4. The apparatus as defined by claim 3, wherein said truncated spherical taper has a spherical radius R and a diameter $d_s$ at a bottom of said truncated spherical taper determined by the following expressions:

$$d_s = D_1 - l \tan \psi$$

$$R \geq l \cos \psi$$

where l is a length of said taper on the lower end of the lower plunger, $D_1$ is the diameter of said lower plunger, Ψ is an angle of said truncated taper on the lower end of said lower plunger.

5. The apparatus as defined in claim 3 wherein said truncated ellipsoidal taper has a diameter $d_e$ at a bottom of said truncated ellipsoidal taper determined by the following expression:

$$d_e = D_1 - l \tan \psi,$$

where l is a length of said truncated taper on the lower end of said lower plunger, $D_1$ is the diameter of said lower plunger, Ψ is an angle of said truncated taper on the lower end of said lower plunger.

6. The apparatus as defined in claim 3 wherein said truncated hyperboloid taper has a diameter $d_h$ at a bottom of said truncated hyperboloid taper determined by the following expression:

$$d_h = D_1 - l \tan \psi,$$

where l is a length of said truncated taper on the lower end of said lower plunger, $D_1$ is the diameter of said lower plunger, Ψ is an angle of said truncated taper on lower end of said lower plunger.

7. The apparatus as defined in claim 3, wherein a distance $L_2$ between a top of the lower plunger and a bottom of said upper plunger is determined by the following expression:

$$\frac{H_1 + L_1 - (l_1 + l_2 + L_{str})}{1 - \frac{(D_1^2 - D_2^2)A_{sw}}{E d_r^2}} \leq L_2 \leq (H_1 + H_2 + L_1) - (l_1 + l_2 + L_{str}),$$

where $H_1$ is the length of the lower cylinder, $H_2$ is a length of the upper cylinder, $l_1$ is a length of the lower plunger, $L_1$ is a length of the compression chamber, $l_2$ is a length of said upper plunger, $L_{str}$ is a length of the upstroke of said pumping unit, $D_1$ is the diameter of said lower plunger, $D_2$ is the diameter of said upper plunger, $A_{sw}$ is the required amplitude of said generated shock wave, E is the modulus of the elasticity of said at least one third sucker rod's material, $d_r$ is the diameter of said at least one third sucker rod.

8. The apparatus as defined in claim 3, wherein the distance $L_4$ between the bottom of said damper plunger and the top of said upper plunger is determined by the following expression:

$$H_1+H_2+H_3+L_1+L_3-(l_1+l_2+l_3+l_{str}) \leq L_4 \leq (H_1+H_2+H_3+L_1+L_3+l_3)-(l_1+l_2+L_2+L_{str}),$$

where $H_1$ is the length of said lower cylinder, $H_2$ is a length of said upper cylinder, $l_1$ is a length of said lower plunger, $L_1$ is a length of said compression chamber, $l_2$ is a length of said upper plunger, $l_3$ is a length of said damper plunger, $H_3$ is a length of said damper cylinder, $L_3$ is a length of said damper chamber, $L_2$ is the distance between the top of said lower plunger and the bottom of said upper plunger, $L_{str}$ is the length of the upstroke of said pumping unit.

9. The apparatus as defined in claim 3 wherein a total length of said at least one first sucker rod connecting a top of said damper plunger and a bottom of said polish rod is reduced compared with the distance between the bottom of said polish rod and the top of said damper plunger at the position of the pumping unit corresponding to the bottom or start of an upstroke by a distance λ determined by the following formulae:

$$\lambda \geq \frac{H}{E}\left[\frac{(D_1^2 - D_2^2)A_{sw}}{d_r^2} + \frac{gH(\rho_s - \rho_f)}{2}\right] + H\eta,$$

where $D_1$ is the diameter of said lower plunger, $D_2$ is the diameter of said upper plunger, $A_{sw}$ is the required amplitude of said generated shock wave, H is a depth of a bottom of said lower plunger at a bottom of said pumping unit upstroke, E is the modulus of the elasticity of the material of said at least one first sucker rod, $d_r$ is the diameter of the at least one first sucker rods, $\rho_s$ is a density of said at least one first sucker rod material, $\rho_s$ is a density of the liquid, π=3.1415, η is a buckling coefficient of said at least one first sucker rod within the tubing per unit of the tubing length.

* * * * *